US007066824B2

(12) United States Patent
Wenzler

(10) Patent No.: US 7,066,824 B2
(45) Date of Patent: Jun. 27, 2006

(54) CHIPPING NET

(75) Inventor: Thomas Wenzler, Setauket, NY (US)

(73) Assignee: Dorson Sports, Inc., Ronkonkoma, NY (US)

( * ) Notice: Subject to any disclaimer, the term of this patent is extended or adjusted under 35 U.S.C. 154(b) by 96 days.

(21) Appl. No.: 10/039,476

(22) Filed: Oct. 19, 2001

(65) Prior Publication Data

US 2003/0078111 A1 Apr. 24, 2003

(51) Int. Cl.
*A63B 69/36* (2006.01)

(52) U.S. Cl. ..... 473/197; 273/400; 473/196

(58) Field of Classification Search ..... 273/398–402, 273/195–197, 170, 172
See application file for complete search history.

(56) References Cited

U.S. PATENT DOCUMENTS

| | | | | | |
|---|---|---|---|---|---|
| 1,063,119 | A | | 5/1913 | Clifford | |
| 1,540,350 | A | | 6/1925 | Longenecker | |
| 1,923,152 | A | | 8/1933 | Kohn | |
| 2,126,102 | A | | 8/1938 | Fowler | |
| 2,915,314 | A | | 12/1959 | Phillips | |
| 3,197,208 | A | | 7/1965 | Makar | |
| 3,484,109 | A | | 12/1969 | Dahlberg | |
| 3,583,703 | A | | 6/1971 | Brown | |
| 3,822,883 | A | | 7/1974 | De Vos | |
| 4,057,252 | A | * | 11/1977 | Pelton | 273/400 |
| 4,171,812 | A | | 10/1979 | Marsin | |
| 4,295,648 | A | | 10/1981 | Stromback | |
| 4,336,939 | A | | 6/1982 | Krumlauf | |
| 4,395,042 | A | | 7/1983 | Boswell | |
| 4,863,166 | A | | 9/1989 | Becera et al. | |
| 5,083,774 | A | | 1/1992 | Yalvac | |
| 5,330,199 | A | * | 7/1994 | Vand | 273/400 |
| 5,433,434 | A | | 7/1995 | Helmetsie | |
| 5,580,320 | A | | 12/1996 | Meikle | |
| 5,803,841 | A | | 9/1998 | Daskoski | |
| 5,816,954 | A | * | 10/1998 | Zheng | 473/471 |

* cited by examiner

*Primary Examiner*—Mark S. Graham
(74) *Attorney, Agent, or Firm*—Furgang & Adwar, LLP

(57) ABSTRACT

The golf practice apparatus has a large target supported by two supports connected at diametrically opposed areas on the large target. For stability, the two supports are connected to one another by a cross member and ground stakes engaging the supports can be inserted into the ground. Successively smaller targets are connected to the larger target. The smaller targets are connected to the large target by a pair of straps. Each pair of straps consists of two sections. The straps are sewn to the middle sized target and have two ends extending radially in each direction from the large target. The straps are wrapped around and secured to both the large target and smaller target. Once wrapped around the respective target, the strap is secured to itself by such conventional means as snaps. In this manner, the smaller target can be removed from the middle target and the middle target can be removed from the larger target. This gives the golfer the option of having just the large target, the large and middle size target, or all three targets, available to receive his/her practice shots.

1 Claim, 4 Drawing Sheets

CHIPPING NET

FIELD OF THE INVENTION

The invention relates to a target for golf practice.

BACKGROUND OF THE INVENTION

Golf is a game having worldwide appeal. Golf courses can be found in virtually every country in the world and millions of people play golf. Since the inception of the game of golf, golfers have devised numerous and sundry devices to help the golfer improve his/her game, and increase the pleasure of playing the challenging sport.

The old golf axiom is that "you drive for show but you putt for dough." This is true because the par for a hole is the number of strokes that it should take to reach the green plus two putts. Being able to use one putt on a hole makes it easier to achieve a low score. If a golfer is close to a green, the golfer hits a shot called a chip, having a high trajectory that will land on the green and not roll far from the cup. The ability to chip the ball close to the hole increases the chances of only having to take a single putt in order to complete the hole. Therefore, accuracy in chipping is a necessary skill in order to improve one's golf game.

The game of golf is old and so are some of the practicing devices. One such practice device is disclosed in U.S. Pat. No. 1,540,350 (Longenecker). The practice apparatus includes an obstruction that is adjustable in height and an open basket into which a ball is to be shot. The golfer must hit the ball over the obstruction and into the basket located on the opposite side of the obstruction.

Kohn, U.S. Pat. No. 1,923,152, discloses a golf practice apparatus having a series of oval targets of varying size placed within each other. Each target has its own net so that the golfer may ascertain how many balls went through each target. The targets are rigidly connected to one another by connecting members 18,19,20. The largest target 11 is rigidly connected to supports 16 to maintain the targets in an upright position.

There is a need in the prior art for a golf target having targets with the inner targets removable from the outermost target. There is also a need for a target that is pivotally connected to supports so that the angle of the targets relative to a horizontal plane is adjustable.

SUMMARY OF THE INVENTION

It is an object of this invention to provide a target having a series of concentric targets connected to each other by a removable connector.

It is another object of the invention to provide a golf practice apparatus that is easily assembled and disassembled for easy storage and transportation.

It is still another object of the invention to provide a golf practice apparatus having targets that are pivotally connected to supports to vary the angle of the targets.

It is yet another object of the invention to provide a practice device that provides feedback to the golfer regarding the accuracy of chip shots.

It is yet another object of the invention to provide a golf practice apparatus that can be secured to the ground.

It is still another object of the invention to provide a practice target that is effective and easy to use.

These and other objects of the invention will become apparent to one of ordinary skill in the art after reading the disclosure of the invention.

In accordance with the teaching of this invention there is provided a golf chipping target which comprises a large target defining a perimeter for receiving golf balls chipped by a golfer. A support is attached to athe target for supporting the large target above a surface. A first net is attached to the perimeter of the large target for retaining golf balls passing through the large target. A second target is removably connected to the large target. The second target is smaller than the large target. A second net is attached to the second target for retaining golf balls passing through the second target.

In accordance with another aspect of this invention there is provided a method for assembling a golf practice device which comprises providing a first target; attaching a pair of supports to the first target by pivotable connections; adjusting the angle between the first target and the pair of supports; and tightening the pivotable connections to fix the angle.

The golf practice apparatus has a large target supported by two supports connected at diametrically opposed areas on the large target. For stability, the two supports are connected to one another by a cross member and ground stakes engaging the supports can be inserted into the ground. A pair of successively smaller targets are connected to the larger target. The smaller targets are connected to the large target by a pair of straps. Each pair of straps consists of two sections. The straps are sewn to the middle sized target and have two ends extending radially in each direction from the large target. The straps are wrapped around and secured to both the large target and smaller target. Once wrapped around the respective target, the strap is secured to itself by such conventional means as snaps. In this manner, the smaller target can be removed from the middle target and the middle target can be removed from the larger target. This gives the golfer the option of having just the large target, the large and middle size target, or all three targets.

BRIEF DESCRIPTION OF THE DRAWINGS

The invention will be described with reference to the drawings.

DETAILED DESCRIPTION OF THE INVENTION

Figure 1:
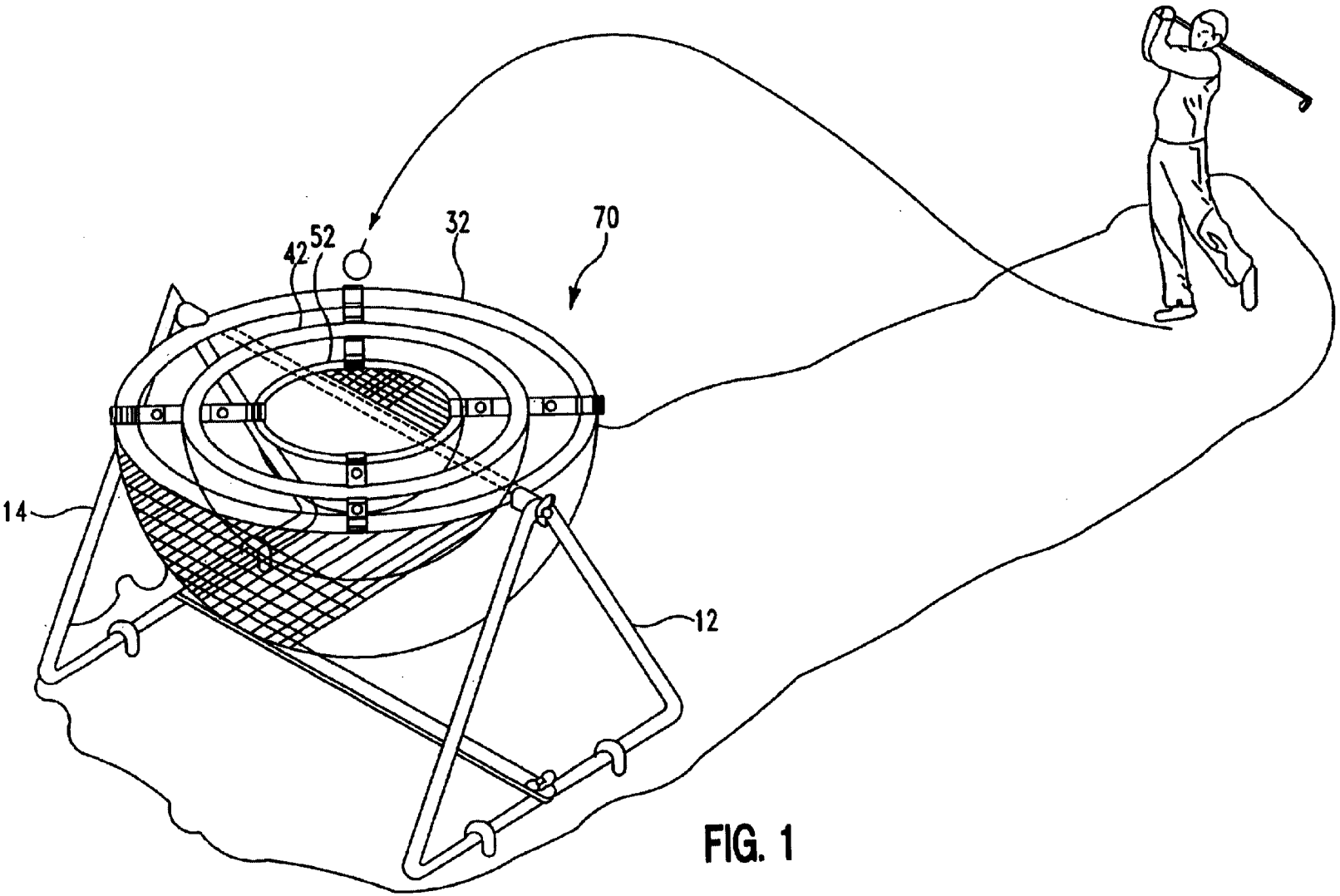
FIG. 1 is a perspective view of the target constructed in accordance with the principles of the instant invention.

The manner in which the target is used is clearly depicted in FIG. 1. As can be seen, the target 10 is set up some distance away from the golfer, to receive the golf balls chipped with appropriate trajectory, toward the target. The series of three concentric targets, each having its own net, is supported above the ground by supports 12, 14. The golfer hits the golf ball, aiming for the target. The goal is to improve accuracy by having the golf ball fall within the smallest target. After the golfer is finished, the number of golf balls which fell within each of the prescribed targets can be ascertained by the number of golf balls captured, or retained, in the net for each target.

Figure 2:
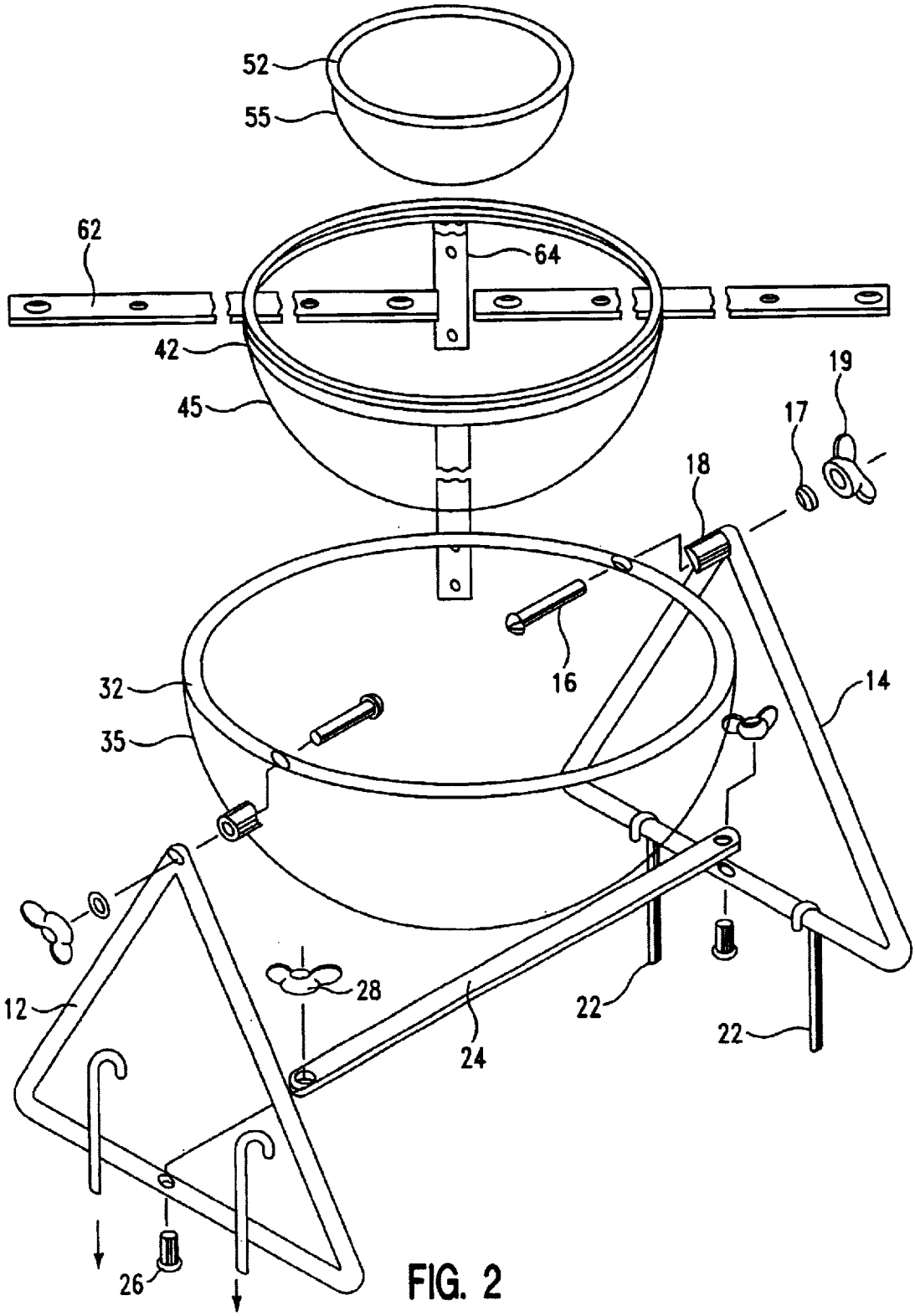
FIG. 2 is an exploded view of the target.

Turning to FIG. 2, an exploded view of the target, and the components comprising the target can be seen. The large target 32 is connected to supports 12, 14 for maintaining the target above the ground. The supports 12, 14 are connected to the large target 32 at diametrically opposed areas. A fastener 16 extends through an aperture in the large target 32, through a ferrule 18, and thence through an aperture in the support. The fastener 16 is retained in this position by washer 17 and threaded retainer 19. The end of the ferrule 18 engaging the large target is contoured to match the curvature of the large target. The reason for this will be explained hereinafter.

Cross member 24 extends between the supports 12, 14. The cross member is secured to each support by a threaded fastener 26 and retainer 28. The supports can be secured to the ground by stakes 22 which include a hooked top end for engaging the supports, and a shaft which is driven into the ground, to retain the chipping net in fixed position.

Medium target 42 has a pair of straps 62, 64 attached to it. Each strap consists of two sections, each section extending from the middle target in both radial directions. At each end of each section is a set of snaps. The purpose of these snaps will be described hereinafter. A smaller target 52 is held within the confines of the medium target 42.

Figure 3:
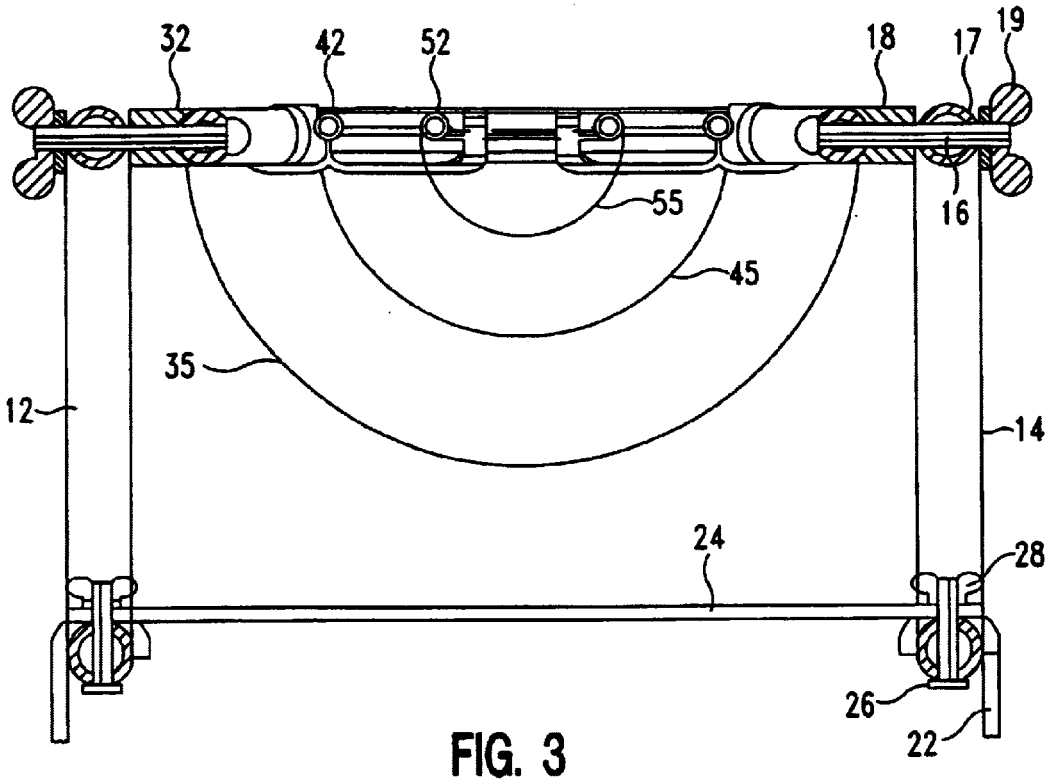
FIG. 3 is a side cross-sectional view of the target.

FIG. 3 shows a vertical cross sectional side view of the target. Clearly seen in this view is how the contoured end of the ferrule 18 conforms to the shape of the large target 32.

Figure 4:
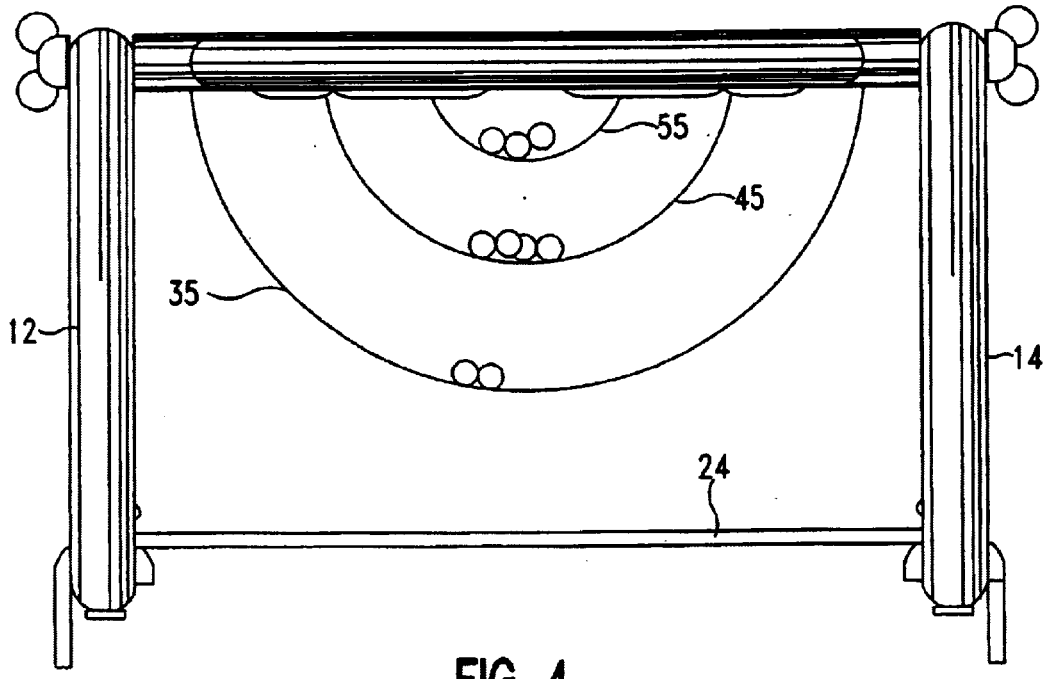
FIG. 4 is a side view of the target.

Also seen is the nets for each individual target. The large target 32, made out of tubing, has first net 35 secured about its perimeter. Likewise, medium sized target 42, made of wire having a smaller diameter than the tubing, has second net 45 secured about its perimeter. Lastly, small target 52 has a third net 55 secured about its perimeter. Therefore, any ball passing through a target will be held within that target's net. This result can be seen in FIG. 4. Each of the nets 35, 45, 55 retains any golf ball passing through its associated target. In this way, the golfer can easily ascertain how many balls went through each target. The goal of practicing a chip shot is to improve accuracy and a golfer will be able to see how close to the center of the target each shot landed.

Figure 5:
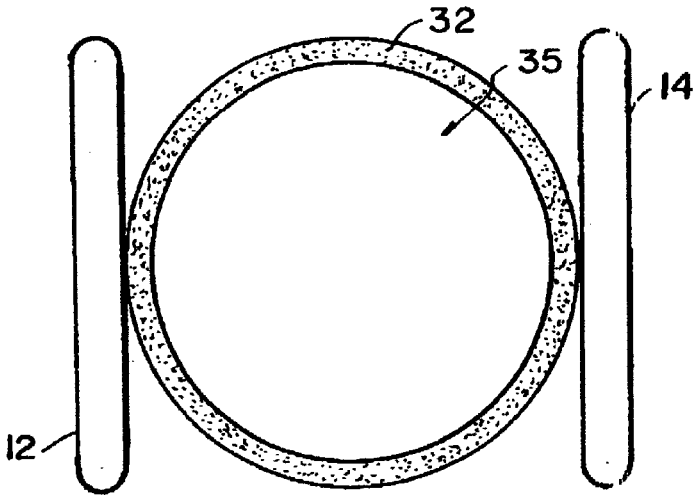
FIG. 5 is a top view of the target having just the large target attached to the supports.
Figure 6:
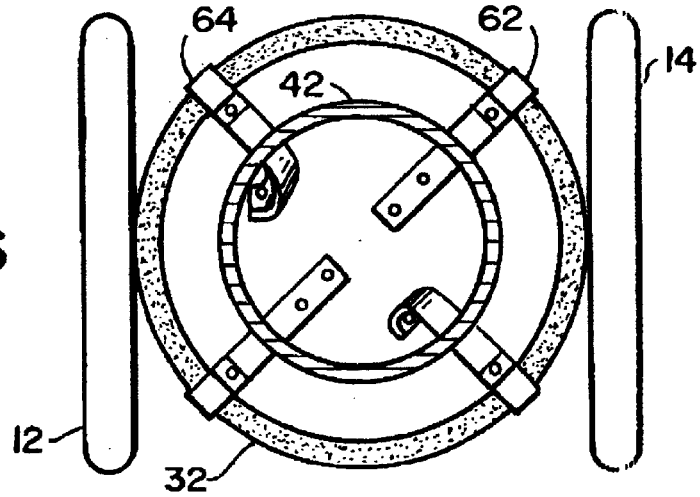
FIG. 6 is a top view of the target having the large and medium targets.
Figure 7:
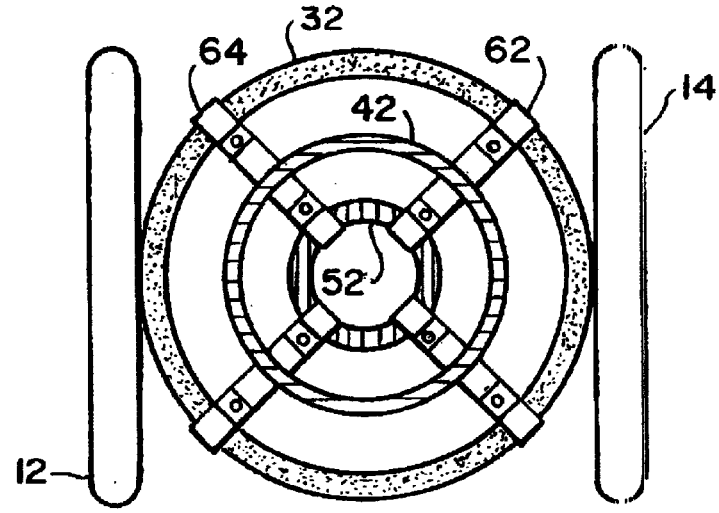
FIG. 7 is a top view of the target having all three targets.

With the construction of the target having been described, the use by a golfer will be described with reference to FIGS. 5–7. FIG. 5 shows a large diameter 32 connected to the supports 12, 14 as previously described. In this configuration, the golfer can use the target with the large target 32 and its associated net 35. If the golfer prefers to add a second target, the medium sized target 42 can be added by use of the straps 64, 62. As is seen in FIG. 5, the end of each strap section extending radially outwardly from the middle sized target has been wrapped about the large target 32. Once wrapped around the target, the snap is attached to itself to maintain the strap in its looped configuration about the large target 32 and maintain the middle sized target in place. A golfer may choose to use the target in this configuration with a large target and a middle target, each with its own associated net. As shown in FIG. 7, the golfer may wish to use all three targets. In this instance, the small target 52 is added and the section of the strap extending radially inwardly from the middle sized target 42 is wrapped about the small target 52. Once looped around, similar to attaching the middle target 42 to the large target 32, the snaps maintain the strap in its looped configuration.

The golfer has the ability to adjust the angle of the large target relative to a horizontal plane. This is easily done by not fully tightening the threaded fastener 16, thereby allowing the large target to pivot relative to the supports 12, 14. Once the desired angle of the large target is achieved, the threaded retainer 19 is tightened so that the large target 32 is maintained at its current angle to the ground. The contoured end of the ferrule, contacting the large target 32, insures that the large target 32, once tightened in position by the threaded fasteners 16, 19, will maintain that position.

Each one of the targets 32, 42, 52 has a different, distinctive color. For instance, the large target 32 can be black, the middle target 42 can be blue, and the smallest target can be red. This will enable the golfer to more easily differentiate the various targets from one another at a distance. Each of the targets can be made of colored material or be enveloped in a colored sleeve, to further enhance the distinctions between the targets.

While the invention has been described with reference to a preferred embodiment, variations and modifications would be obvious to one of ordinary skill in the art without departing from the scope of the invention. Such variations and modifications fall within the purview of the invention as defined in the appended claims. For instance, any type of mating fastener may be used in place of the snap fasteners on the straps 62, 64 for securing the middle target to the large target and the small target to the middle target. Also, more than three targets could be used. Consequently, the claims should be broadly construed, commensurate with the spirit and scope of the instant invention, and should not be limited to their literal terms.

What is claimed is:

1. A method for assembling a golf practice device, comprising:

providing a first target;

attaching a pair of triangular supports to the first target by pivotable connections;

adjusting the angle between said first target and said triangular pair of supports;

tightening the pivotable connections to fix the angle;

attaching a second and a third target to the first target, the second target being smaller than the first target and the third target being smaller than the second target;

providing straps; and attaching the second and third targets to the first target by the straps.

* * * * *